US006289805B1

(12) United States Patent
Douillard et al.

(10) Patent No.: US 6,289,805 B1
(45) Date of Patent: Sep. 18, 2001

(54) DEVICE AND METHOD FOR DRIVING A PRINTING CYLINDER

(75) Inventors: Gerald Roger Douillard, Dover, NH (US); Mark Bernard Dumais, Kennebunk, ME (US); Michael Robert Lemellin, Dover, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/499,794

(22) Filed: Feb. 8, 2000

(51) Int. Cl.[7] ..... B41F 13/24
(52) U.S. Cl. ..... 101/247; 101/218
(58) Field of Search ..... 101/247, 216, 101/217, 218, 182, 184, 185; 74/86

(56) References Cited

U.S. PATENT DOCUMENTS

| | | | | |
|---|---|---|---|---|
| 3,721,130 | * | 3/1973 | McKee | 74/86 |
| 3,724,368 | | 4/1973 | Treff | 101/248 |
| 3,960,079 | * | 6/1976 | Capetti | 101/232 |
| 4,309,945 | * | 1/1982 | Marion | 101/247 |
| 4,953,461 | * | 9/1990 | Gaffney et al. | 101/142 |
| 5,357,858 | | 10/1994 | Guaraldi et al. | 101/216 |
| 5,678,485 | | 10/1997 | Guaraldi | 101/247 |

OTHER PUBLICATIONS

U.S. Patent application Ser. No. 09/165,621 filed Mar. 10, 1999.

U.S. Patent application Ser. No. 08/979,108 filed Nov. 26, 1997.

* cited by examiner

*Primary Examiner*—Ren Yan
(74) *Attorney, Agent, or Firm*—Davidson, Davidson & Kappel, LLC

(57) ABSTRACT

A printing press including a printing cylinder and a printing cylinder drive, the drive including a drive motor connected to a sun gear, a planet gear rotating about a fixed axis and driven by the sun gear, and a ring gear fixedly attached to the printing cylinder and driven by the planet gear. Also provided is a method for driving a printing cylinder comprising the steps of driving a sun gear using a drive motor, the sun gear driving a planet gear and a ring gear, the ring gear being fixedly attached to the printing cylinder.

12 Claims, 3 Drawing Sheets

DEVICE AND METHOD FOR DRIVING A PRINTING CYLINDER

BACKGROUND OF THE INVENTION

1. Field of the Invention

The present invention relates generally to printing presses and more particularly to a device and method for driving a printing cylinder in a printing press.

2. Background Information

Printing cylinders of printing presses print a material, such as paper. In offset web printing, the printing cylinders include a plate cylinder and a blanket cylinder. Typically, a plate on the plate cylinder engages the blanket on the blanket cylinder, as a web or sheet of material passes between the blanket and an impression cylinder. Ink is transferred from an ink roller to the plate cylinder, and ink corresponding to an image is transferred to the blanket and then to the web or sheet. For two sided printing, the impression cylinder is another blanket cylinder.

The plate and blanket cylinders are driven on a gear side of a printing press by a drive mechanism, which typically comprises gearing for driving each of the printing cylinders. A single or multiple motors can power the drive mechanism. Hitachi-Seiko, for example, has a two motor drive for driving two printing cylinders in a four-cylinder printing unit. Heidelberg Web Press, Inc. has a three motor drive for driving three printing cylinders of a four cylinder printing unit.

In order to prevent wrap-up during a web break in web printing presses, or to change plates or blankets on the respective cylinders, it is sometimes necessary to throw-off the plate cylinder from the blanket cylinder, and also to throw-off the blanket cylinder from the impression cylinder. The mechanisms which move the printing cylinders are called throw-off mechanisms.

Because the plate and blanket cylinders still need to rotate during throw off, the drive mechanism must remain engaged during throw-off.

U.S. Pat. No. 5,678,485 purports to disclose an offset printing press having a counterpoise and lift mechanism. The counterpoise is provided for permitting an axial blanket or printing sleeve to be slid over a respective cylinder. The lift mechanism is a throw-off mechanism for throwing-off, for example, the plate cylinder. A drive mechanism is not disclosed.

U.S. Pat. No. 3,724,368 purports to disclose a drive mechanism and a throw-off mechanism for an offset printing press. An harmonic drive means provides for register adjustment of both plate cylinders. The primary drive for the printing press is provided through a motor connected to one of the blanket cylinders.

The printing press manufacturer MAN Roland has a direct drive for a blanket cylinder. The motor is moved during throw-off and the motor drives the blanket cylinder in a 1:1 ratio.

One problem with the above-devices is that the motors to drive the cylinders are large and space-consuming, and are often difficult to adjust. Moreover, the motors often must be moved along with the cylinders during throw-off, which can create a complicated and difficult structure.

BRIEF SUMMARY OF THE INVENTION

An object of the present invention is to permit smaller drive motors for printing cylinders and to permit the motors to operate at higher speeds. A further or alternate object of the present invention is to permit the motor to be fixed, even during throw-off.

The present invention thus provides a printing press including a printing cylinder and a printing cylinder drive, the drive including a drive motor connected to a sun gear, a planet gear rotating about a fixed axis and driven by the sun gear, and a ring gear fixedly attached to the printing cylinder and driven by the planet gear.

The planetary gear arrangement of the present invention permits the use of higher speed motors, since the sun gear rotates at a higher rotational speed than the ring gear. A lower inertial ratio on the motor may thus be maintained. The use of higher motor speeds also permits better electronic control of the speed of the printing cylinder.

Preferably, the printing cylinder is a blanket or plate cylinder of an offset printing press.

Also preferably, the printing cylinder has a first position in which the printing cylinder is engaged for printing and a second position in which the printing cylinder is thrown-off. The motor remains in a same position during both the first and second positions of the printing cylinder, while the ring gear moves with the printing cylinder, but remains engaged with the planet gear.

The use of a fixed motor is highly advantageous, in that it becomes much easier to throw-off the cylinder if the motor does not also need to be moved.

The printing press also preferably includes a throw-off device connected to the printing cylinder, the throw-off device including a pivotable lever for moving the printing cylinder.

The printing cylinder may be gapped or preferably may be cantileverable, so that a sleeve such as a gapless blanket or gapless plate may be slid over one end of the printing cylinder.

The gear ratio provided by the planetary gear arrangement preferably is four-to-one, i.e. the sun gear and motor rotate at four times the rotational speed of the ring gear and printing cylinder.

Preferably, the printing cylinder is a plate cylinder of an offset printing press also including a blanket cylinder, the blanket cylinder being driven by a drive gear connected to the ring gear, the drive gear connected to a driven gear fixedly attached to the blanket cylinder. If the blanket and plate cylinders are 1:1 in size, the drive gear is preferably the same size as the driven gear.

The planet gear preferably has an anti-backlash design. The planetary gear arrangement also may have a uniflank arrangement to minimize backlash.

The motor could be arranged to slide axially coupled with helical gearing to provide circumferential movement for registering the printing cylinder. Alternatively, the circumferential register can be provided through the drive motors.

The present invention also provides a method for driving a printing cylinder comprising the steps of:

driving a sun gear using a drive motor, the sun gear driving a planet gear and a ring gear, the ring gear being fixedly attached to the printing cylinder.

Preferably, the method further includes throwing off the printing cylinder while keeping the drive motor stationary.

BRIEF DESCRIPTION OF THE DRAWINGS

One embodiment of the present invention is described below by reference to the following drawings, in which.

DETAILED DESCRIPTION

Figure 1:
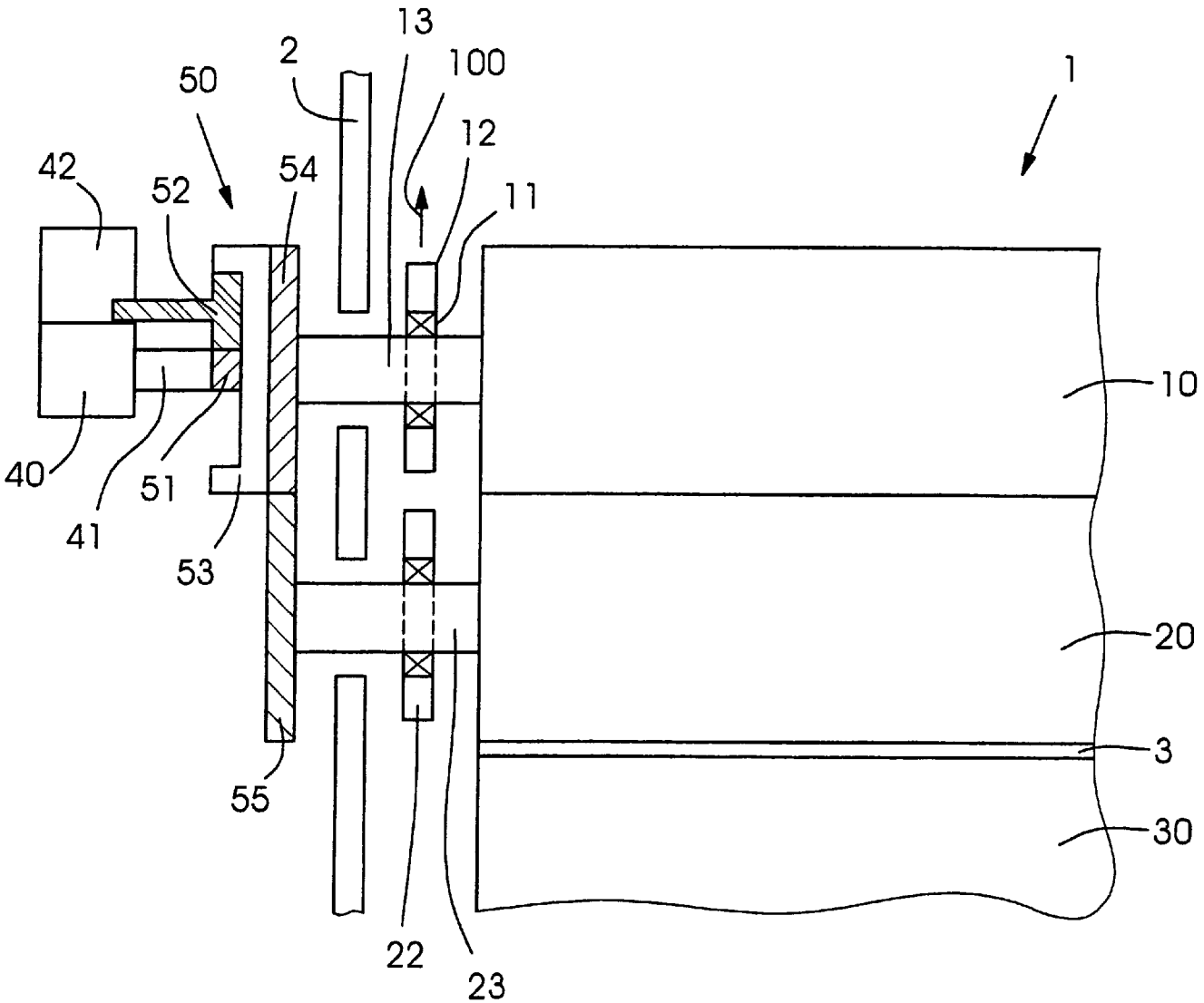
FIG. 1 shows a schematized top view of a partial top view of an embodiment of the present invention.

FIG. 1 shows a partial top view of an offset lithographic printing press 1 having a gear side frame 2, a plate cylinder 10 and a blanket cylinder 20. A web 3 of material such as paper for newspaper printing travels upward between the blanket cylinder 20 and an impression cylinder 30, which preferably is a blanket cylinder having an associated plate cylinder.

Figure 4:
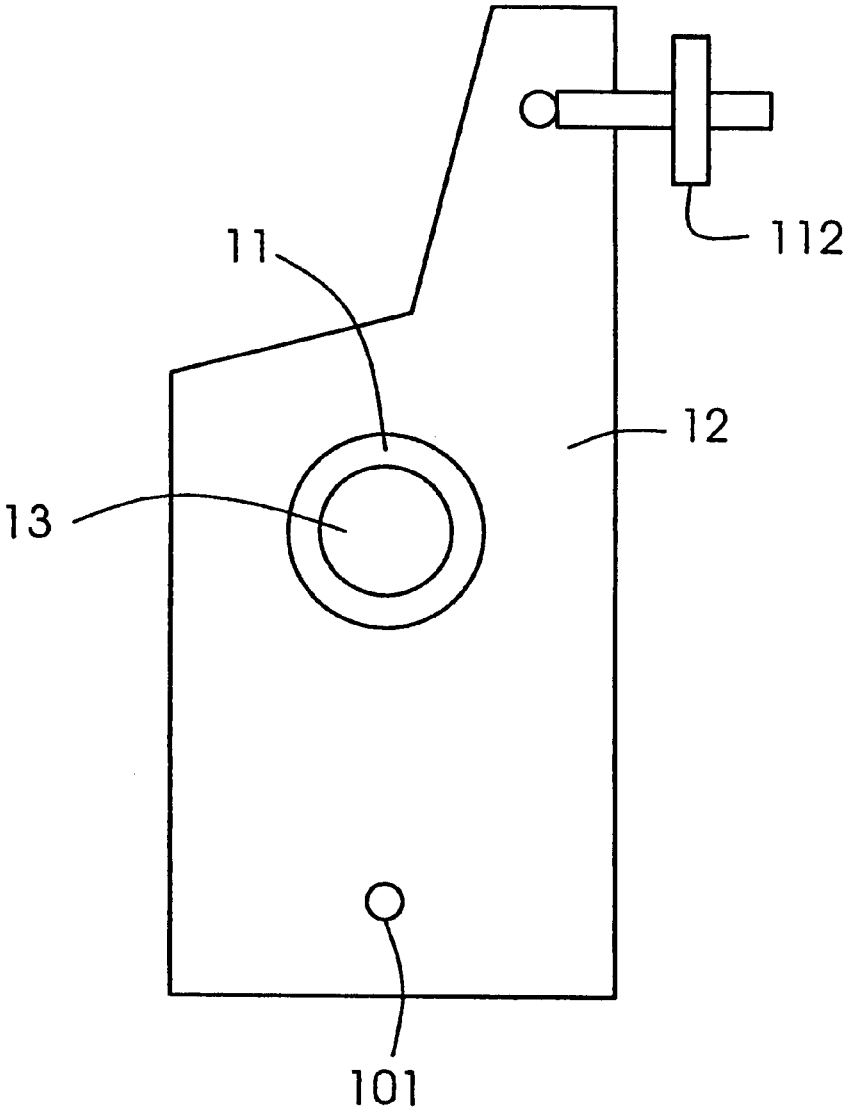
FIG. 4 shows a schematized view of a throw-off lever for use with the embodiment of FIG. 1.

The plate cylinder 10 has an end 13 rotatingly supported in a bearing 11 located in a lever 12. As shown in FIG. 4, lever 12 is attached fixedly at a bottom end through a pivot 101 to frame 2 and is moveable at a top end by an air piston 102 connected between frame 2 and lever 12. The lever 12 and air piston 102 define a throw-off mechanism for moving plate cylinder 10 away from blanket cylinder 20 in the direction of arrow 100, as shown in FIG. 1.

Plate cylinder 10 is driven by a motor 40 located in a housing 42. Motor 40 has a drive axle 41. Housing 42 is fixed, which as defined herein means that the axis of drive axle 41 is always the same. The housing 42 however may slide axially, for example by being placed on a track with a moveable drive.

Drive axle 41 is connected to a sun gear 51 of a planetary gear arrangement 50, and advantageously is coaxial with the rotational axis of plate cylinder 10. Sun gear 51 drives a planet gear 52 which is rotatingly supported in housing 42. The axis of planet gear 52 is fixed with respect to the axis of sun gear 51, although as defined herein the planet gear 52 being fixed means solely that planet gear 52 remains engaged with sun gear 51, even if their axis move slightly apart from one another.

Planet gear 52 drives a ring gear 53 which is attached fixedly to end 13 of plate cylinder 10.

Also attached to end 13 is a drive gear 54 for driving a driven gear 55, which is connected to an end 23 of blanket cylinder 20. End 23 of blanket cylinder 20 is supported in a throw-off lever 22, similar to throw-off lever 12.

Figure 2:
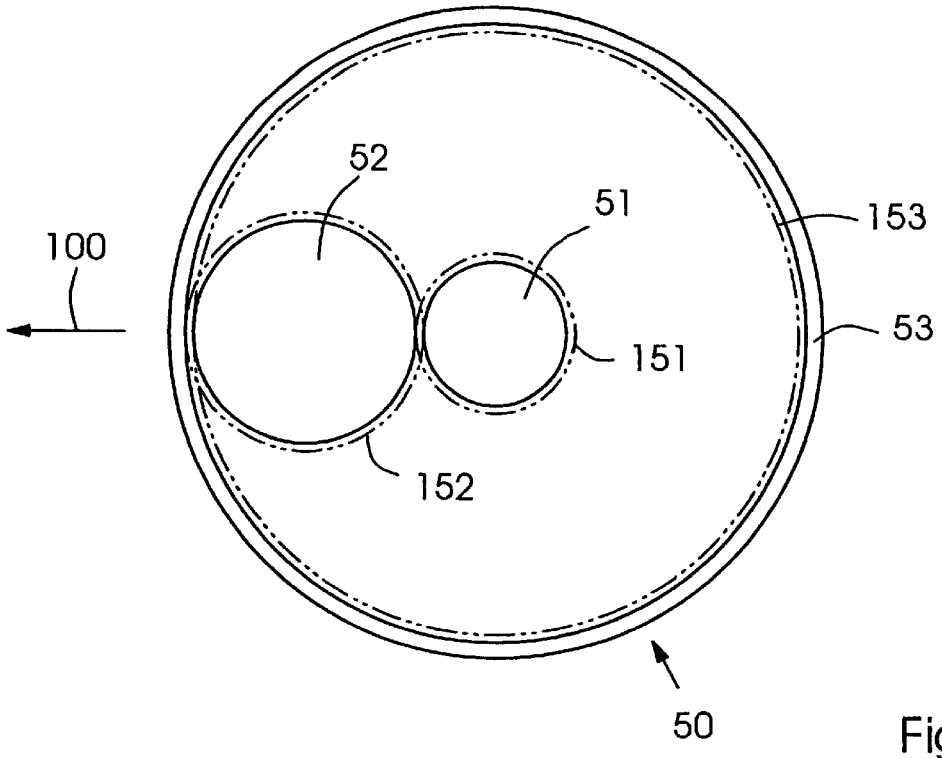
FIG. 2 shows a schematized side view of the drive gearing of the embodiment shown in FIG. 1.

FIG. 2 shows the planetary gear arrangement 50 in more detail, when the plate cylinder 10 is in an engaged position for printing. Ring gear 53 has gear teeth 153, indicated by dotted lines. Sun gear 51 has gear teeth 151, which mesh with gear teeth 152 of planet gear 52. Gear teeth 152 also mesh with gear teeth 153. The sun gear may have for example 30 teeth, the planet gear 45 teeth and the ring gear 120 teeth, so that a 4:1 ratio is provided.

After throw-off lever 12 is moved in direction 100 so as to move plate cylinder 10 into a throw-off position (a similar lever on the work side is moved simultaneously), the ring gear 53 moves sideways in direction 100 as well. The sun gear 51 and the planet gear 50, however, remain fixed.

Figure 3:
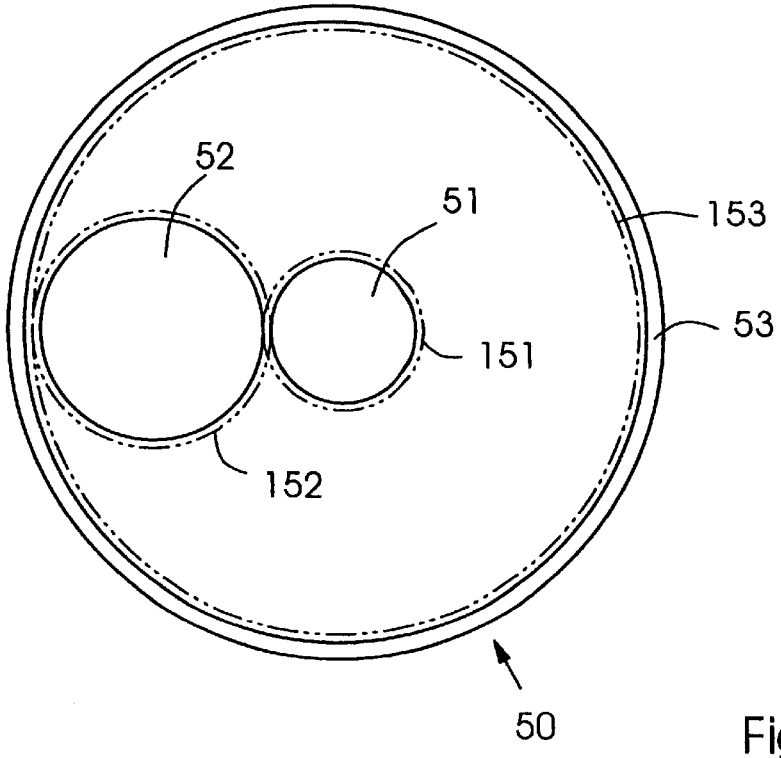
FIG. 3 shows the drive gearing of FIG. 2 after throw-off of the printing cylinder.

FIG. 3 shows the planetary gear arrangement 50. When the plate cylinder is in its throw-off position, gear teeth 151 and 152 remain fully meshed, since the motor 40 and housing 42 are stationary. The gear teeth 153 move away from gear teeth 152 of planet gear 52, but the teeth remain engaged, even if not fully meshed.

The gear teeth 153 and 152 are of such length that they remain engaged even during throw-off. Likewise the teeth of gears 54 and 55 also remain engaged during throw-off.

Thus, plate cylinder 10 and blanket cylinder 20 can still be rotated during throw-off by drive motor 40.

The teeth 152 of planet gear 52 may have an anti-backlash design, as disclosed in commonly assigned and co-pending U.S. patent application No. 09/165,621, filed on Mar. 10, 1999, and hereby incorporated by reference herein. Alternatively, a uniflank mechanism could be incorporated to reduce backlash, as disclosed in U.S. Pat. No. 5,357,858, also hereby incorporated by reference herein.

Blanket cylinder 30 and its associated plate cylinder may have similar drive and throw-off mechanisms. However, it is also possible that these cylinders are driven by motor 40 through gearing, such as gears attached to gear 55.

U.S. Pat. No. 5,678,485 is hereby incorporated by reference herein. Printing cylinders and throw-off mechanisms similar to those described therein, as well as the work aside arrangement of the press, could be incorporated into the present invention.

The motor 40 can be controlled by an electronic controller, such as a microprocessor. The speed of the motor can thus be varied.

While the drive unit has been shown directly driving the plate cylinder, it could also drive the blanket cylinder directly as well.

What is claimed is:

1. A printing press comprising:

a printing cylinder; and a printing cylinder drive, the drive including a drive motor connected to a sun gear having a sun gear axis, a single planet gear rotating about a planet gear axis fixed with respect to the sun gear axis, the planet gear being driven by the sun gear, and a ring gear fixedly attached to the printing cylinder and being driven by the planet gear, the ring gear being movable with respect to the planet gear so as to permit a throw-off position of the printing cylinder, the ring gear remaining engaged with the planet gear in the throw-off position.

2. The printing press as recited in claim 1 wherein the printing cylinder is one of a blanket cylinder and a plate cylinder of an offset printing press.

3. The printing press as recited in claim 1 wherein the motor is stationary.

4. The printing press as recited in claim 1 further comprising a throw-off device for moving the printing cylinder into the throw-off position.

5. The printing press as recited in claim 4 wherein the throw-off device includes a pivotable lever.

6. The printing press as recited in claim 1 wherein the gear ratio provided by the sun, planet and ring gears is 4:1.

7. The printing press as recited in claim 1 wherein the printing cylinder is a plate cylinder and further comprising a blanket cylinder operably connected to the plate cylinder through a driven gear.

8. The printing press as recited in claim 1 wherein at least one of the sun, ring and planet gear have means for reducing backlash.

9. The printing press as recited in claim 1 wherein the sun gear is coaxial with a rotational axis of the printing cylinder.

10. A method for driving a printing cylinder comprising the steps of:

driving a sun gear using a drive motor, the sun gear driving a single planet gear and a ring gear, the ring gear being fixedly attached to the printing cylinder, the ring gear being movable with respect to the planet gear so as to permit a throw-off position of the printing cylinder, the ring gear remaining engaged with the planet gear during the throw-off position.

11. A method for driving and throwing-off a printing cylinder comprising the steps of:

driving a sun gear using a drive motor, the sun gear driving a planet gear and a ring gear, the ring gear being fixedly attached to the printing cylinder; and throwing off the printing cylinder by moving the ring gear with respect to the planet gear while keeping the drive motor stationary.

12. A printing press comprising:

a printing cylinder; and means for driving the printing cylinder, the drive means including a drive motor connected to a sun gear having a sun gear axis, a planet gear rotating about a planet gear axis fixed with respect to the sun gear axis, the planet gear being driven by the sun gear, and a ring gear having a ring gear axis fixedly attached to the printing cylinder and being driven by the planet gear, the ring gear axis being movable with respect to the planet gear axis.

* * * * *

UNITED STATES PATENT AND TRADEMARK OFFICE

CERTIFICATE OF CORRECTION

PATENT NO. : 6,289,805 B1 
DATED : September 18, 2001
INVENTOR(S) : Gerald Roger Douillard, Mark Bernard Dumais and Michael Robert Lemelin It is certified that error appears in the above-identified patent and that said Letters Patent is hereby corrected as shown below:

Title page,
Item [75], the third inventor's correct name should read -- Michael Robert Lemelin --

Signed and Sealed this

Twelfth Day of November, 2002

*Attest:*

*Attesting Officer*

JAMES E. ROGAN
*Director of the United States Patent and Trademark Office*